US005085537A

United States Patent [19]

Laditka

[11] Patent Number: 5,085,537

[45] Date of Patent: Feb. 4, 1992

[54] METHODS AND APPARATUS FOR DISPENSING, MIXING, AND APPLYING COATING CONSTITUENTS TO TRAFFIC SURFACES

[76] Inventor: Alexander Laditka, 4741 Dalebridge #C-10, Warrensville Hts., Ohio 44128

[21] Appl. No.: 586,909

[22] Filed: Sep. 24, 1990

Related U.S. Application Data

[63] Continuation-in-part of Ser. No. 368,084, Jun. 19, 1989, Pat. No. 4,958,955, which is a continuation of Ser. No. 213,449, Jun. 28, 1988, abandoned, which is a continuation of Ser. No. 85,253, Aug. 11, 1987, abandoned, which is a continuation of Ser. No. 892,337, Aug. 1, 1986, abandoned, which is a continuation-in-part of Ser. No. 532,742, Sep. 16, 1983, Pat. No. 4,603,999, which is a continuation-in-part of Ser. No. 408,484, Aug. 16, 1982, Pat. No. 4,477,203.

[51] Int. Cl.[5] ..... E01C 7/06; E01C 23/08; E01C 19/22

[52] U.S. Cl. ..... 404/75; 404/92; 404/101; 404/112

[58] Field of Search ..... 404/75-77, 404/101-102, 112, 111, 44-45

[56] References Cited

U.S. PATENT DOCUMENTS 782,459 2/1905 Morris .
831,494 9/1906 Alexander .
1,224,294 5/1917 Franzen .
1,437,863 12/1922 Raymond .
1,591,682 7/1926 Ponselle .
1,914,950 6/1933 Kanen .

(List continued on next page.)

FOREIGN PATENT DOCUMENTS 945037 12/1963 United Kingdom ..... 15/49 R

OTHER PUBLICATIONS

*Now the Seal-Rite Applicator* brochure, Seal-Rite Applicator, Inc.

An untitled brochure published by Erie-Go Manufacturing Co.

*Applicator for Emulsified Asphalt & Tar Seal Cost Materials*, Pavers Mfg. Co.

(List continued on next page.)

*Primary Examiner*—Ramon S. Britts
*Assistant Examiner*—Nancy Connolly
*Attorney, Agent, or Firm*—David A. Burge

[57] ABSTRACT

A system for applying a coating to a traffic surface utilizes a power driven unit that dispenses coating constituents onto the traffic surface as the unit moves forwardly across the traffic surface along a path of travel. The unit includes a wheel supported transport carriage beneath which is provided at least one set of applicator tools that rotates relative to the carriage about a substantially vertically extending center axis. A hollow, tubular stub shaft and bearings connect the set of tools to the carriage for rotation about the center axis. As the unit moves forwardly, at least a portion of the coating constituents that are being dispensed onto the traffic surface are ducted along the center axis through the hollow stub shaft for discharge substantially centrally relative to the associated set of rotating tools, whereby the set of rotating tools is brought into engagement with deposited constituents, thereby causing the tools mix the constituents in situ, and to spread and apply the mixed constituents to coat the traffic surface in a highly effective manner. One or more storage compartments are defined atop the transport carriage for containing bulk quantities of coating constituents, and an adjustable valving system is provided to regulate the dispensing of the coating constituents. Tubular arms pivotally connect with the hollow stub shaft for rotation therewith and for rotating the tools about the center axis. The weight of the tools and their associated arms serves to bias the tools toward engagement with the traffic surface. A trailing finishing blade depends from the carriage to effect final smoothing of the applied coating, and to minimize wheel marks in the resulting coating.

41 Claims, 6 Drawing Sheets

U.S. PATENT DOCUMENTS

| | | | |
|---|---|---|---|
| 2,033,510 | 3/1936 | Brayley | 16/24 |
| 2,175,511 | 10/1939 | Wahlstrom et al. | 94/44 |
| 2,200,921 | 5/1940 | Granell | 51/177 |
| 2,241,214 | 5/1941 | Milster | 188/152 |
| 2,277,389 | 3/1942 | Conway | 94/45 |
| 2,668,976 | 2/1954 | Beach | 15/230 |
| 2,717,725 | 9/1955 | Bennett | 222/485 |
| 2,725,945 | 12/1955 | Beaudoux et al. | 100/6.24 |
| 2,754,733 | 7/1956 | Beyer | 94/45 |
| 2,779,965 | 2/1957 | Schilberg | 16/26 |
| 2,796,202 | 6/1957 | Lawrence et al. | 222/233 |
| 2,796,203 | 6/1957 | Masters et al. | 222/311 |
| 2,799,037 | 7/1957 | Grogan | 15/172 |
| 2,835,120 | 5/1958 | Foley | 222/485 |
| 2,962,946 | 12/1960 | Neff | 94/44 |
| 3,130,658 | 4/1964 | Talbott | 94/45 |
| 3,153,992 | 10/1964 | Dabelle | 94/44 |
| 3,183,803 | 5/1965 | Gierhart | 94/44 |
| 3,187,145 | 6/1965 | Ashley, Jr. et al. | 188/16 |
| 3,206,174 | 9/1965 | Young | 259/149 |
| 3,221,619 | 12/1965 | Erickson | 94/50 |
| 3,241,976 | 3/1966 | Rank et al. | 94/44 |
| 3,245,329 | 4/1966 | Nagin et al. | 94/22 |
| 3,279,337 | 10/1966 | Weaver | 94/44 |
| 3,283,675 | 11/1966 | Gifford et al. | 94/39 |
| 3,305,887 | 2/1967 | Turner | 15/50 |
| 3,333,518 | 8/1967 | Sholl et al. | 94/44 |
| 3,452,381 | 7/1969 | Bratti | 15/98 |
| 3,458,885 | 8/1969 | Danielsson | 15/50 |
| 3,515,041 | 6/1970 | Murtaugh | 94/44 |
| 3,533,336 | 10/1970 | Wikel | 94/44 |
| 3,550,866 | 12/1970 | Swenson | 239/677 |
| 3,559,543 | 2/1971 | Schwoebel, Jr. | 94/44 |
| 3,580,638 | 5/1971 | Pullen | 299/25 |
| 3,683,761 | 8/1972 | Babic | 94/45 |
| 3,703,856 | 11/1972 | Wikel et al. | 94/44 |
| 3,771,893 | 11/1973 | Miller | 404/101 |
| 3,776,430 | 12/1973 | Grandrud | 222/177 |
| 3,791,754 | 2/1974 | Zochil | 404/112 |
| 3,807,634 | 4/1974 | Vogt | 239/150 |
| 3,841,779 | 10/1974 | Ray | 404/111 |
| 3,936,212 | 2/1976 | Holz, Sr. et al. | 404/112 |
| 3,989,403 | 11/1976 | Verive | 404/111 |
| 4,074,385 | 2/1978 | Howard et al. | 15/180 |
| 4,096,879 | 6/1978 | Serur et al. | 137/391 |
| 4,172,580 | 10/1979 | Raftis et al. | 251/8 |
| 4,302,127 | 11/1981 | Hodson | 404/102 |
| 4,302,128 | 11/1981 | Thatcher | 404/111 |
| 4,315,700 | 2/1982 | Heiligtag et al. | 404/111 |
| 4,318,631 | 3/1982 | Vickers | 404/93 |
| 4,350,293 | 9/1982 | Lestradet | 239/155 |
| 4,357,953 | 11/1982 | Patterson | 137/88 |
| 4,365,377 | 12/1982 | Todd et al. | 15/98 |
| 4,477,203 | 10/1984 | Laditka | 404/111 |
| 4,603,999 | 8/1986 | Laditka | 404/112 |
| 4,958,955 | 9/1990 | Laditka | 404/75 |

OTHER PUBLICATIONS

*Specialized Sealcoating Equipment for Quality Jobs*, Contract Asphalt Maintenance Co.

*Seal-Master*, Asphalt Maintenance Equipment by Wikel.

*Seal-Mor*, Neal Mfg. Co., Inc.

*Seal Master Blacktop Sealing Machine* brochure, Wikel Mfg. Co.

*Huber SC-150 Sealcoat Applicator* brochure, Huber Corp.

*Nu-Surf Seal Applicator* brochure, Gierhart Machinery Co.

*Asphalt Sealing Machine* brochure, Allied Steel & Tractor Products, Inc.

*The New Surf-Seal for Asphalt Sealcoating* brochure, Specialized Equipment of Wakeman.

*Seal-Master Applicator* brochure, Winkel Mfg. Co.

*Now the Erie Applicator* brochure, Erie Applicator, Inc.

METHODS AND APPARATUS FOR DISPENSING, MIXING, AND APPLYING COATING CONSTITUENTS TO TRAFFIC SURFACES

CROSS-REFERENCE TO RELATED PATENTS AND APPLICATIONS

The present application is a continuation-in-part of application Ser. No. 07/368,084 filed Jun. 19, 1989, (issued Sep. 25, 1990, as U.S. Pat. No. 4,958,955—referred to hereinafter as the Third Parent Case), which was filed as a continuation of U.S. Ser. No. 07/213,449 filed Jun. 28, 1988, (abandoned), which was filed as a continuation of U.S. Ser. No. 07/085,253 filed Aug. 11, 1987, (abandoned), which was filed as a continuation of U.S. Ser. No. 06/892,337 filed Aug. 1, 1986, (abandoned), which was filed as a continuation-in-part of U.S. Ser. No. 06/532,742 filed Sep. 16, 1983, (issued Aug. 5, 1986, as U.S. Pat. No. 4,603,999—referred to hereinafter as the Second Parent Case), which was filed as a continuation-in-part of U.S. Ser. No. 06/408,484, filed Aug. 16, 1982, (issued Oct. 16, 1984, as U.S. Pat. No. 4,477,203—referred to hereinafter as the First Parent Case), the disclosures of all of the aforementioned being incorporated herein by reference.

The invention disclosed and claimed herein is the work product of a continuing development effort that resulted in the inventions which constitute the subjects matter of the First, Second and Third Parent Cases (referred to collectively hereinafter as the Parent Cases), and provides a number of improvement features that can be used separately from or in conjunction with features of the inventions of one or more of the Parent Cases, as will be apparent from the description and claims that follow, taken together with the accompanying drawings.

BACKGROUND OF THE INVENTION

1. Field of the Invention

The present invention relates to the application of coating constituents to form desired types of coatings on relatively large surface areas that characteristically are referred to as "traffic surfaces," typically roadway surfaces such as highways, streets, driveways, parking lots, runways, taxiways, and tarmacs that are of sufficient size to warrant the use of relatively large power operated machinery to dispense and mix coating constituents to form desired types of coatings, and to spread and apply the mixed constituents to form coatings of desired character that are intended to protect, restore and enhance traffic surface integrity.

More particularly, the present invention relates to a center-fed system for dispensing coating constituents onto a traffic surface, for mixing the dispensed constituents in situ on the traffic surface (to such extent may be needed), for spreading the mixed constituents, and for effecting a controlled application of the resulting coating by utilizing at least one set of rotary tools that extends beneath a wheeled support carriage, with the tools of each such set being connected to a separate, hollow, tubular stub shaft that is journaled for rotation relative to the carriage about the stub shaft's vertically extending center axis. In accordance with a feature of the present invention, at least a portion of the coating constituents that are to be applied to a traffic surface are dispensed onto the traffic surface as by being ducted through the hollow stub shaft(s) for discharge substantially centrally relative to the associated set(s) of rotating tools, whereby the tools are brought into engagement with the deposited constituents to effect desirable types of in situ mixing, spreading and application of the deposited constituents to the traffic surface.

2. Prior Art

In the present document, the term "traffic surface" is used in a generic sense to refer to a wide class of substantially horizontal surfaces such as highways, streets, driveways, parking lots, runways, taxiways, tarmacs, floors of large garages and industrial buildings, loading dock decks, and the like that need to be coated from time to time to protect, restore and enhance surface integrity.

Because traffic surfaces are exposed to wear and often to the effects of the elements, they are subject to deterioration and periodically require the application of coatings to protect, restore and enhance their integrity, and to thereby extend their useful lives. Some traffic surfaces should be coated when constructed, as by the application of a coating that seals exposed surfaces and thereby protects against water penetration that, in winter, can cause spalding or cracking. Many traffic surfaces require protective and reconditioning coatings periodically and/or after the surfaces have been subjected to a certain amount of use.

Due to the wide variety of materials that are used to form traffic surfaces, the wide range of uses to which traffic surfaces are subjected, and the many types of coating constituents that are available to protect against specific kinds of wear and deterioration, there has been a longstanding need for a highly versatile system for dispensing, mixing, spreading and applying coatings to traffic surfaces. The need has been particularly pressing with respect to the protective coating of traffic surfaces of large area such as highways, airport runways, bridge roadways, and the like where manual dispensing, mixing, spreading and application of coating constituents is impractical.

While a variety of proposals have been made for apparatus to dispense, mix, spread and coat large traffic surfaces, most prior proposals have been characterized by drawbacks such as a lack of versatility of the apparatus to dispense, mix, spread and apply coating constituents of a wide range of kinds and types, and/or a lack of adjustability to enable coating applications to be made that differ in desired ways such as thickness and the degree to which the resulting coating conforms to the shape of the surface being coated (e.g., whether the coating tends to smooth or diminish surface irregularities). Indeed, the problems that are associated with efforts to provide a highly versatile traffic surface coating system have been deemed to be so extensive in character that it has become standard practice to design and build traffic surface coating apparatus such that it is intended to apply only a limited selection of coating constituents, with the apparatus being designed for use on only selected types of traffic surfaces.

Further and significant limitations of many prior applicator proposals reside in such drawbacks as 1) their inability to effectively dispense and admix in situ materials such as epoxy substances, fibrous, beaded, or heavy particulates, 2) their inability to effectively dispense and admix in situ quick-setting soluble substances to form uniform slurry compositions, and/or 3) their inability to properly spread and apply resulting coatings.

3. The Referenced Parent Cases

While the referenced Parent Cases address certain of the foregoing and other drawbacks of prior proposals as by providing novel and improved systems that are well suited for use in a wide variety of coating application situations, the approach that has tended to be employed in carrying out the preferred practice of the inventions of the referenced Parent Cases is one of applying coating constituents to traffic surfaces at locations that are spaced from where sets of rotary tools are operating. Typically, prior proposals call for one or more sets of rotary tools to be moved forwardly along paths of travel in order to bring the rotary tools into engagement with deposited coating constituents to effect such functions as the mixing of constituents, and the spreading and application of the resulting coating.

Not specifically addressed by the inventions of the referenced Parent Cases are certain advantages that have been found to result from taking a somewhat different approach than is described above, namely the approach of dispensing selected coating constituents at a central location or at central locations about which one or more sets of rotary tools are moving. The system of the present invention provides such advantages, as will become apparent from the discussion that follows. Thus, while the system of the present invention may, in some modes of practice, make use of a number of features that are disclosed in the referenced Parent Cases, the system of the present invention provides improved method and apparatus features that extend beyond the scope of the referenced Parent Cases.

SUMMARY OF THE INVENTION

The present invention addresses the foregoing and other drawbacks of the prior art by providing a system that is capable of dispensing, mixing, spreading and applying coating constituents on smooth and/or irregular traffic surfaces ranging in size from relatively small to relatively large, wherein a power driven apparatus is utilized that carries at least one set of rotary tools, with the tools of each such set being rotated about a separate, substantially vertically extending center axis, and with coating constituents being center-fed as by being ducted along a center axis for discharge onto the traffic surface at a location or locations that are relatively central with respect to one or more associated sets of rotating tools that serve to mix, spread and apply the deposited constituents as the apparatus moves forwardly along a path of travel.

The present invention represents the work product of a continuing development program that also generated the subjects matter of the referenced Parent Cases. An advantage of the present invention resides in the fact that its features do not necessarily exclude the use of or supplant concurrent use of many of the features of the inventions of the referenced Parent Cases. Thus, the present invention can be utilized together with selected features of the inventions of the Parent Cases while, at the same time, providing advantages that result from also utilizing a center-fed system for dispensing selected coating constituents, thereby providing versatility, controllability, ease of use, and many other advantages.

Likewise, features of the present invention also can be employed quite usefully "on their own" so as to provide advantages of a center-fed dispensing system used with at least one array of rotary tools to effect mixing, spreading and application of dispensed coating constituents. Thus, features of the present invention can be utilized in a variety of manners and modes to provide a highly versatile system for dispensing, mixing, spreading and applying coating constituents of a wide variety of types on traffic surfaces of widely differing characteristics and sizes.

In accordance with the preferred practice of the present invention, a system for applying a coating to a traffic surface utilizes a power driven unit that dispenses coating constituents onto the traffic surface as the unit moves forwardly across the traffic surface along a path of travel. The unit preferably includes a wheel supported transport carriage beneath which is provided at least one set of applicator tools that rotates relative to the carriage about a substantially vertically extending center axis. A hollow, tubular stub shaft and bearings preferably are provided to connect the set of tools to the carriage for rotation about the center axis. As the unit moves forwardly, at least a portion of the coating constituents that are being dispensed onto the traffic surface are ducted along the center axis through the hollow stub shaft for discharge substantially centrally relative to the associated set of rotating tools, whereby the set of rotating tools is brought into engagement with deposited constituents, thereby causing the tools mix the constituents in situ, and to spread and apply the resulting mixture of constituents to coat the traffic surface.

In preferred practice, a plurality of storage compartments are defined atop the transport carriage for containing bulk quantities of coating constituents, and an adjustable valving system is provided to separately regulate the dispensing of the coating constituents from each of the storage compartments. While at least one of the storage compartments is utilized to supply center-fed constituents for dispensing at one or more central locations relative to one or more sets of rotating tools, others of the compartments may be used to supply non-center-fed dispensing apparatus (e.g., such dispensing apparatus as is disclosed in the referenced Parent Cases).

In preferred practice, tubular arms pivotally connect with a rotary member that is bearing-mounted on the stub shaft for rotation about the center axis. The tubular arms also pivotally connect with the rotary tools. These pivotal connections permit movement of the tools relative to the rotary member so that the tools can move toward and away from the traffic surface in a manner that assists in maintaining engagement between the tools and the traffic surface as the tools are rotated about the center axis. The weight of the tools and their associated arms preferably serves to bias the tools toward engagement with the traffic surface. Selected ones of the pivot axes about which the tools are movable relative to the arms may be inclined slightly relative to the horizontal (e.g., by about five degrees relative to a horizontal plane) so as to rearwardly incline the blades as they depend from the arms. This slight inclination often is useful in helping to minimize or prevent tool "chatter," and tends to assure that a smooth coating application can be provided by the apparatus.

In preferred practice, a trailing finishing blade depends from rearward portions of the carriage to effect final smoothing of the applied coating, and to minimize wheel marks in the resulting coating. The finishing blade is adjustably connected to the carriage so that it can be adjusted vertically as may be needed to accommodate wear and to assure that the blade is positioned properly with respect to the traffic surface during operation of the apparatus.

While the preferred embodiment of the invention that is depicted in the drawings and that is described later herein includes only one set of rotary tools and defines only one center axis about which a set of rotary tools rotates to effect mixing, spreading and application of coating constituents, it will be understood by those who are skilled in the art that a plurality of rotary tool units, each rotating about a separate, substantially vertically extending center axis, can be utilized to advantage, for example in such "tandem" arrangements as are described and illustrated in the referenced Third Parent Case In one form of practice, the "tandem" rotary tool units are arranged side-by-side so that, as the apparatus is moved forwardly along a path of travel, each of the side-by-side rotary tool units treats a separate portion of the width of a "treatment zone" or "travel path" that is traversed by the apparatus. In another form of practice, at least some of the rotary tool units are arranged relatively forwardly and rearwardly with respect to each other so that as the apparatus is moved forwardly along its travel path, the forward and rearward rotary tool units are brought sequentially into contact with portions of the treatment zone. In this latter form of practice, it is possible (and, indeed preferable in many instances) to utilize the forward and rearward rotary tool units to serve somewhat different but complementary functions. For example, the forward rotary tool units can have their rotary blades urged into contact with the traffic surface area being treated, whereby the forward finishing assemblies serve to mix and spread coating constituents and to work the constituents into the pores of the surface that is being treated—whereas the rearward finishing assemblies can have their rotary blades held in spaced relationship above the surface being treated so that they serve to effect a smooth application of the resulting coating so that it has a predetermined average coating thickness.

In still another form of practice, the forward rotary tool units can (through the use of their hollow stub shafts to duct coating constituents onto the traffic surface being coated) serve to effect a first center-fed dispensing and mixing in situ of selected coating constituents; and, the rearward tool units can (through the use of their hollow stub shafts to duct coating constituents onto the traffic surface being coated) serve to effect a second dispensing and mixing in situ of other selected coating constituents—whereby selected coating constituents can be deposited onto and at least partially mixed, spread and/or applied to a traffic surface before other selected coating constituents are deposited, mixed, spread and applied. Inasmuch as staged or separate deposits of coating ingredients often represent desirable approaches to use in effecting desired types of coating applications (e.g., in conjunction with applications of liquids that are to be mixed with particulates, or in conjunction with applications of constituents that harden or cure when mixed to form epoxy coatings, etc.), the use of staged center-fed sets of rotary tools represents a good example of how features that are disclosed in the referenced Parent Cases can be combined with features of the present invention to provide desired types of system performance.

Other features of the referenced Parent Cases likewise can be used with the system of the present invention, as will be readily apparent from the description and claims that follow, taken in conjunction with the accompanying drawings. For example, center-fed dispensing of certain constituents often is desirable so as to bring the deposited constituents first into contact with the relatively slow moving inner end regions of the rotary tools to effect a relatively gentle mixing, followed by a radially outward distribution and spreading of the mixed constituents (which subjects the mixed constituents to the more vigorous and faster moving action that is provided by radially-outwardly-located portions of the blades) as the application of the coating is effected. However, non-center-fed dispensing (i.e., dispensing at one or more locations forward of the location of rotary tools) often is desirable where the limited mobility of the constituent being dispensed (e.g., sand—which may require a considerable amount of energy to spread across the width of the travel path) can be advantageously spread relatively uniformly onto the traffic surface at a location ahead of the center-fed dispensing of more mobile constituents (e.g., water-like slurries and other non-viscous liquids) which tend to be relatively easy to spread across the width of the travel path as by the action of rotary tools engaging center-fed deposits.

Other advantages that can obtain through the use of features of the inventions of the referenced Parent Cases reside in the provision of finishing apparatus that is capable of effecting uniform, in situ mixing of coating ingredients that range in consistency from very thin, slurry-like liquids to very viscous tar-like gels and/or particulates. Where very viscous ingredients are being used, often it is desirable to utilize arrays of alternating mixing and spreading tools. By way of example (and as is described in detail in the referenced Parent Cases), rake-like mixing tools may be used to break up and mix particulate coating ingredients with viscous slurry coatings so that blade-like spreading tools can effect application of coating materials with a desired degree of uniformity.

BRIEF DESCRIPTION OF THE DRAWINGS

The foregoing and other features of the invention will be better understood by referring to the description of the preferred embodiment and the claims which follow, taken together with the accompanying drawings, wherein:

DESCRIPTION OF THE PREFERRED EMBODIMENT

Figure 1:
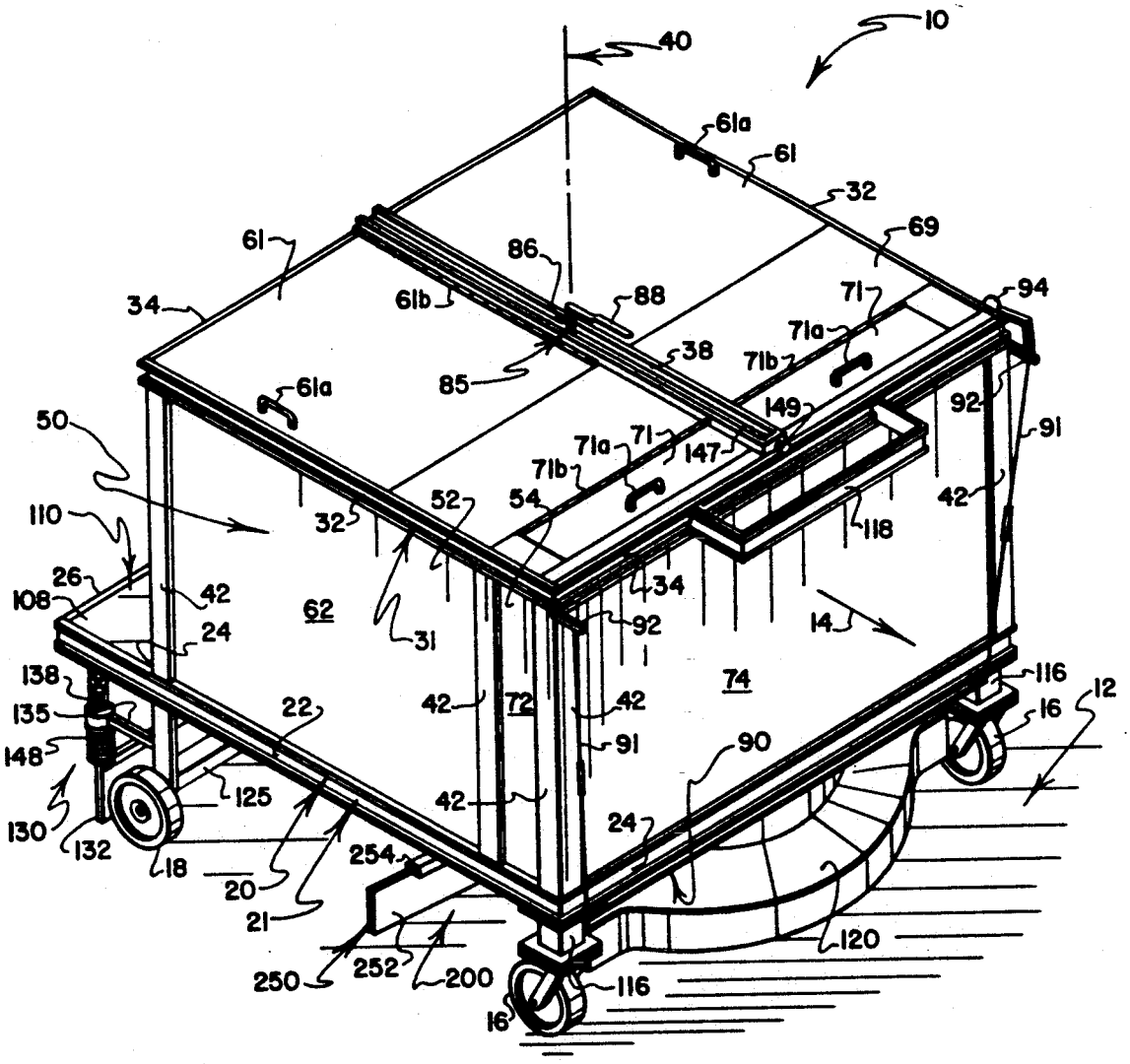
FIG. 1 is a perspective view of a surface finishing apparatus that embodies the preferred practice of the present invention, with the apparatus employing a set of rotary tools to mix, spread and apply coating constituents to traffic surface portions that underlie a wheel-supported carriage portion of the apparatus, with the view showing principally top, front and right side portions thereof.
Figure 2:
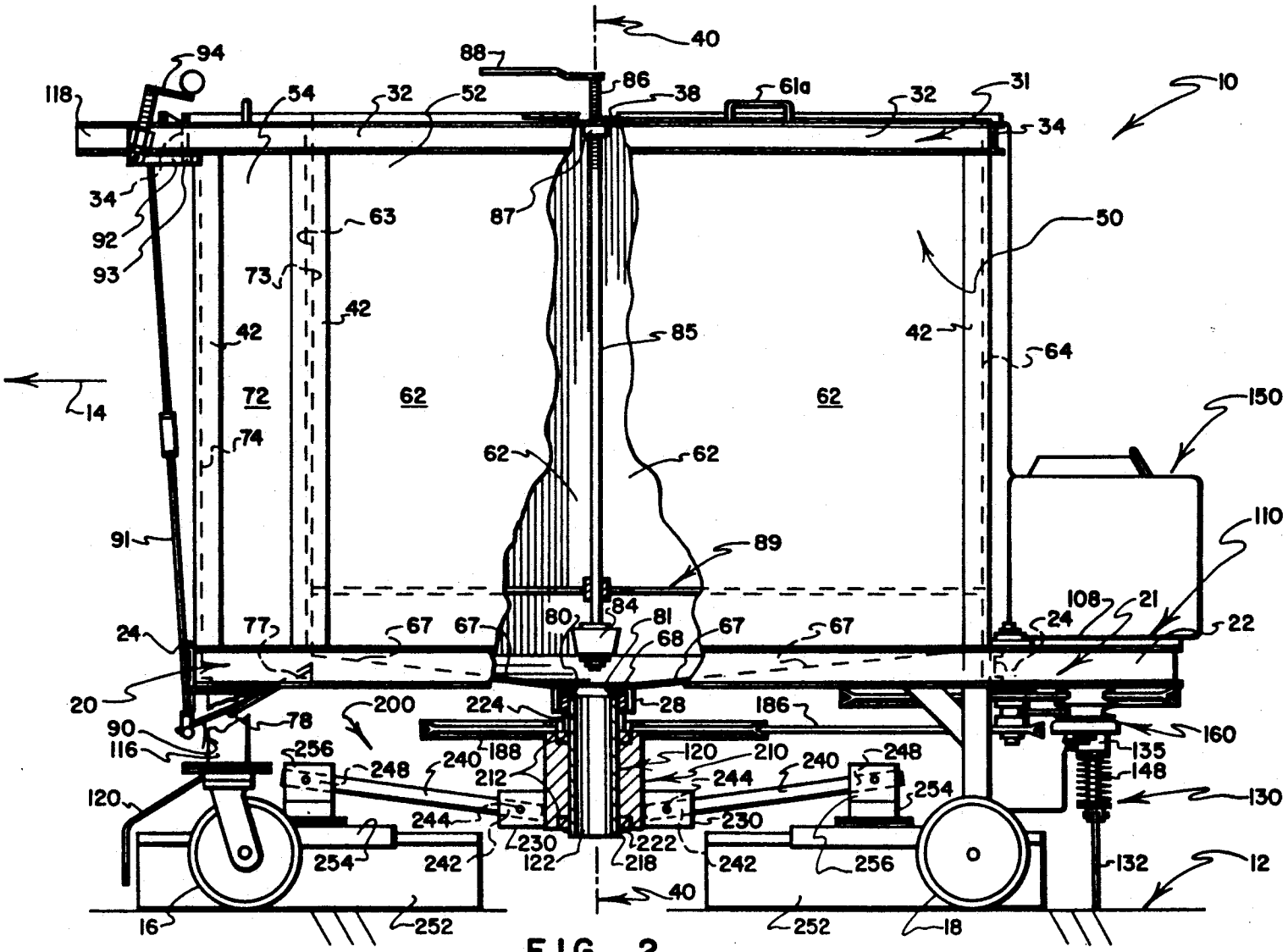
FIG. 2 is a left side elevational view thereof with portions broken away to permit certain otherwise hidden features to be seen, and with a few hidden features depicted by broken lines.
Figure 3:
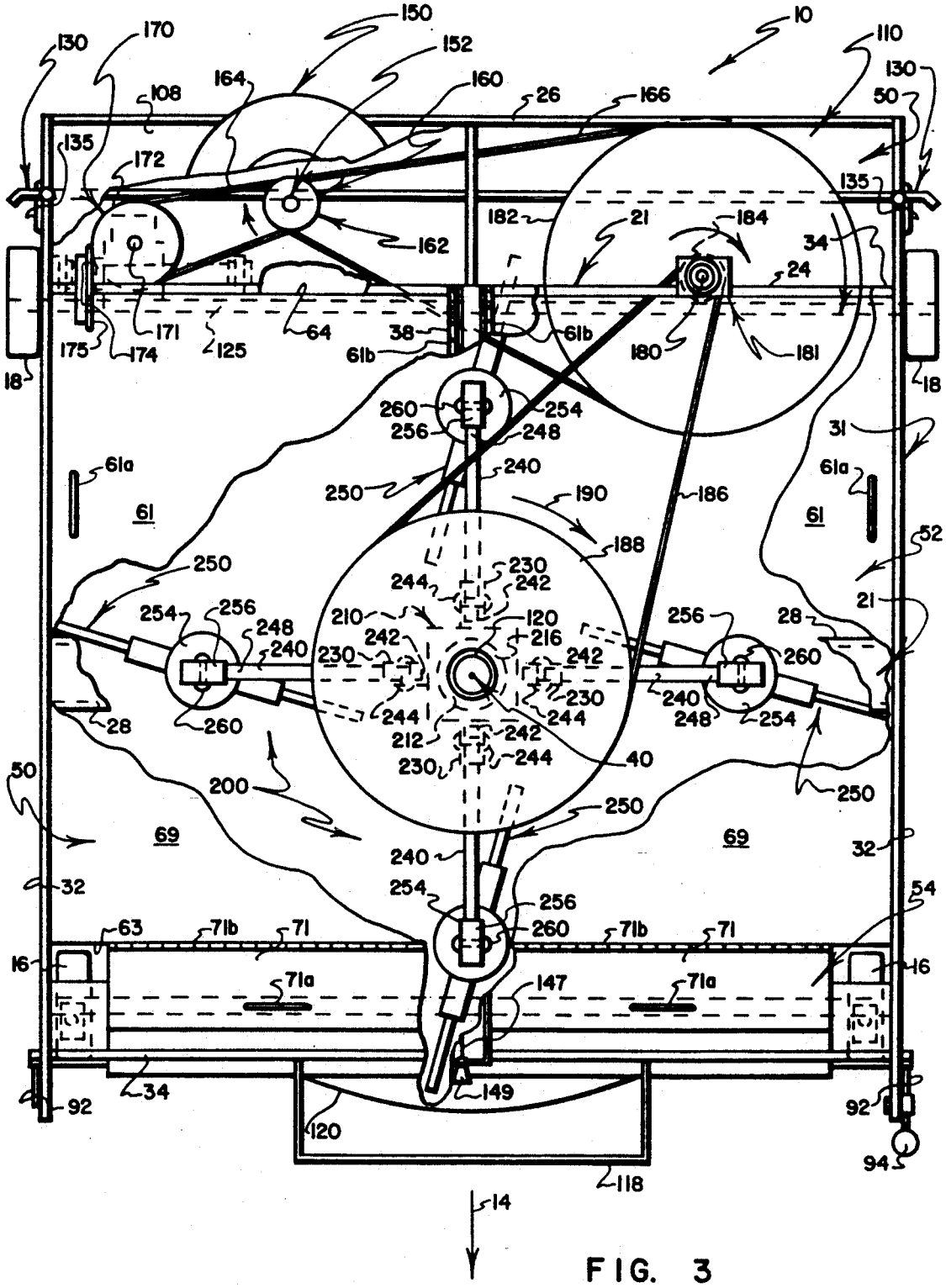
FIG. 3 is a top plan view thereof with portions broken away to permit certain otherwise hidden features to be seen, and with a few hidden features depicted by broken lines.
Figure 4:
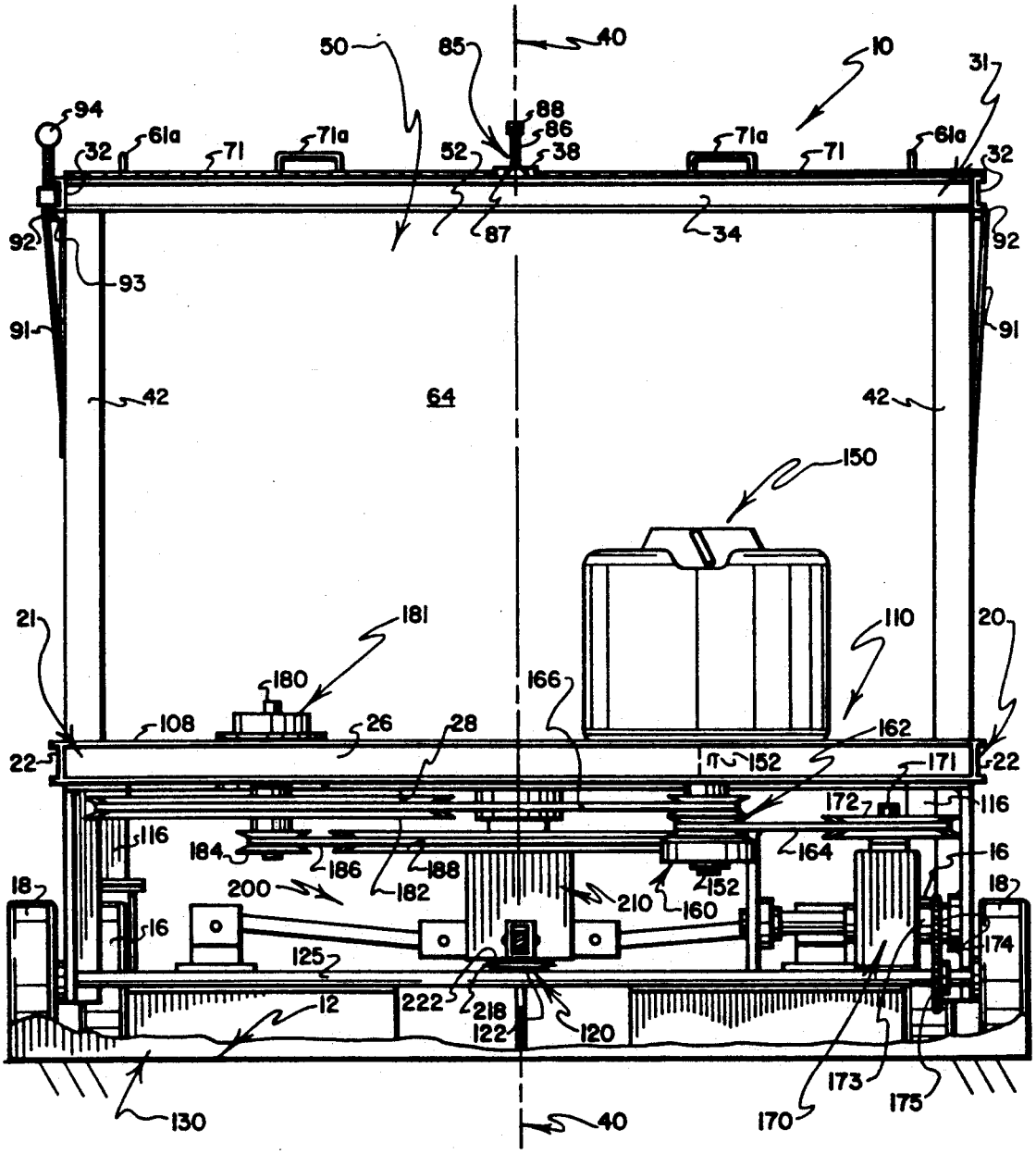
FIG. 4 is a rear elevational view thereof with portions broken away to permit certain otherwise hidden features to be seen, and with a few hidden features depicted by broken lines.

Referring to FIGS. 1–4, a preferred form of apparatus or machine for dispensing, mixing, spreading and applying coating constituents to traffic surfaces is indicated generally by the numeral 10. In FIGS. 1, 2 and 4, the machine 10 is shown positioned atop a traffic surface 12.

An imaginary "center axis" of the machine 10 is depicted in FIGS. 1, 2 and 4 by a centerline, indicated by an arrow 40. In FIG. 3, the machine's center axis is depicted by a dot, indicated by an arrow 40. The center axis 40 extends substantially normal to (i.e., substantially perpendicular to) the plane of the traffic surface 12. When the plane of the traffic surface 12 is horizontal (i.e., as it is depicted in FIGS. 1, 2, 4, 6 and 7), the center axis 40 extends substantially vertically. However, if the plane of the traffic surface that is supporting the machine 10 does not extend horizontally, it will be understood by those who are skilled in the art that the center axis 40 will be correspondingly inclined from the vertical. Thus, while for purposes of simplification in many portions of this document, the center axis 40 is referred to by such terms as "extending vertically," it will be understood that such references technically are true only if the traffic surface 12 atop which the machine 10 is positioned extends horizontally, as is depicted in the accompanying drawings. Clearly, the use of such terms as "extending vertically" or "being substantially vertical" in referring to the center axis 40 is not intended to limit the coverage that is afforded herewith.

Referring to FIGS. 1, 2 and 4, the apparatus or machine 10 includes forward and rearward wheels 16, 18 that support a carriage structure 20 for movement across the traffic surface 12. The wheels 16, 18 support the carriage structure 20 so that it is positioned to extend substantially parallel to the plane of such portions of the traffic surface 12 as underlie and are engaged by the wheels 16, 18. When the traffic surface portions that underlie and support the wheels 16, 18 extend in a substantially horizontal plane, the carriage structure 20 likewise extends substantially horizontally.

The carriage structure 20 preferably is formed as a welded assembly of a plurality of lengths of channel-shaped steel members that include such components as a pair of side bars 22 that extend along lower portions of the left and right sides of an upstanding, generally rectangular tank assembly that is indicated generally by the numeral 50; a pair of front and rear cross bars 24 that extend along lower portions of the front and rear sides of the tank assembly 50 (with the bars 22, 24 cooperating to perimetrically surround bottom portions of the tank assembly 50); a trailer bar 26 that extends between and rigidly connects rear end regions of the left and right side bars 22, and that extends in parallel spaced relationship to the rear one of the cross bars 24; and a bottom beam 28 that extends between and rigidly connects with opposed central portions of the left and right side bars 22 (with the bottom beam 28 extending parallel to the front and rear cross bars 24 at a location that intercepts the center axis 40). The components 22, 24, 26 and 28 define a rigid, welded, lower framework (indicated generally by the numeral 21) that receives and supports lower portions of the tank assembly 50.

Similarly, a rigid, welded, upper framework (indicated generally by the numeral 31) is formed principally from channel-shaped steel members and serves to receive and support upper portions of the tank assembly 50. The upper framework 31 includes such components as a pair of side bars 32 that extend along upper portions of the left and right sides of the tank assembly 50; a pair of front and rear cross bars 34 that extend along upper portions of the front and rear sides of the tank assembly 50 (with the bars 32, 34 cooperating to perimetrically surround top portions of the tank assembly 50); and, a top beam 38 that extends between and rigidly connects with opposed central portions of the front and rear cross bars 34 (with the top beam 38 extending parallel to the left and right side bars 32 at a location that intercepts the center axis 40).

A plurality of upright members 42 are welded to and rigidly interconnect various components of the lower framework 21 with corresponding components of the upper framework 31. As will be noted from a review of the drawings, the upright members 42 parallel the center axis 40 but are located principally near corner regions of the tank assembly 50 and near junctures between individual tank-like containers that are carried within the frame structures 21, 31 to comprise the tank assembly 50 (i.e., the uprights 42 preferably are positioned near junctures of front and rear walls with side walls of such tank-like containers 52, 54 as comprise the tank assembly 50, as will be explained in greater detail).

The tank assembly 50 can define a single compartment for receiving coating constituents that are to be dispensed onto the traffic surface 12, or can define a plurality of compartments for receiving segregated quantities of coating constituents. Moreover, the lower and upper frame structures 21, 31 that are described above, may, if desired, be constructed so that the top beam 38 can be removed temporarily from the upper framework 31 to permit substitution of one or more alternate tank-like containers (not shown) in place of one or both of the containers 52, 54 that are depicted as comprising the tank assembly 50, whereby the versatility of the apparatus or machine 10 can be enhanced.

What specifically comprises the tank-like containers that form the tank assembly 50 of the machine 10 are a pair of generally rectangular welded steel tanks that are indicated by the numerals 52, 54. The tank 52 is the larger of the two, and it occupies a central position extending along the center axis 40 and overlying a set of rotary tools 100 that is rotatably supported beneath the carriage structure 20, as will be explained. The large tank 52 extends from side to side within the confines of the lower and upper frameworks 21, 31 so as to define rearward portions of the tank assembly 50. The tank 54 is a smaller tank that is located forwardly with respect to the tank 52 and extends from side to side within the confines of the lower and upper frameworks 21, 31 so as to define frontal portions of the tank assembly 50.

Referring variously to FIGS. 1–4, the large tank 52 has opposed side walls 62 (FIGS. 1, 2) that are engaged near their lower and upper end regions by the side bars 22, 32; has a front wall 63 (FIG. 2) that extends in juxtaposition with a rear wall 73 (FIG. 2) of the small tank 54; has a rear wall 64 (FIGS. 3, 4) that is engaged near its lower and upper end regions by the rear ones of the cross bars 24, 34; has a complexly inclined bottom wall 67 (FIG. 2) with a center portion 68 that is engaged by the bottom beam 28; and has a fixed upper wall portion 69 (FIG. 1) that extends between the side walls 62 and is engaged by the top bar 38. Likewise, the small tank 54 also has opposed side walls 72 (FIGS. 1, 2); has a rear wall 73 (FIG. 2) that extends in juxtaposition with the front wall 63 of the large tank 52; has a front wall 74 (FIG. 1) that is engaged near its lower and upper end regions by the front ones of the cross bars 24, 34; and has bottom wall 77 (FIG. 2) that is inclined forwardly and downwardly, and that carries a transversely extending hinge 78 that pivotally mounts a discharge door 90 that extends across a majority of the width of the front of the machine 10 at a location beneath the front tank 54 for selectively permitting and preventing discharge of contents of the tank 54 onto the path of travel that is being followed as the machine 10 moves forwardly in the direction of the arrow 14.

Dispensing of contents from the forward tank 54 (typically particulate material such as sand) is controlled by a pair of rod-like links 91 that have their lower end regions pivotally connected to opposite end regions of the pivotally mounted door 90. The links 91 have upper end regions that pivotally connect with a pair of levers 92 that are located near forward end regions of the side bars 32. A shaft 93 extends across the front side of the tank 54 to rigidly interconnect the levers 92 for concurrent pivotal movement. An adjustable crank handle 94 is provided to position the levers 92, and to thereby operate the links 91 to selectively open and close the discharge door 90. Contents that discharge through the opening that is controlled by the door 90 are prevented from dropping onto rotating tools 250 (that are located beneath the carriage structure 20) by the forwardly extending skirt 120 which deflects portions of the discharging contents slightly forwardly for deposit along the travel path of the machine 10.

Referring to FIG. 1, a pair of pivoted doors 61 provide access to the interior of the tank 52 or selectively close open top portions of the tank 52. Handles 61*a* are provided on the doors 61 for pivoting the doors about hinged mounts that are indicated by the numeral 61*b*. A pair of pivoted doors 71 provide access to the interior of the tank 54 or selectively close open top portions of the tank 54. Handles 71*a* are provided on the doors 71 for pivoting the doors about hinged mounts that are indicated by the numeral 71*b*.

Referring to FIG. 2, a central outlet opening 80 is provided in the bottom wall 67 of the large tank 52. The outlet opening 80 extends in coaxial relationship with the center axis 40. Communicating with the outlet opening 80 is an aligned opening 81 that is formed through the bottom beam 28. Welded to the bottom beam 28 is a hollow, tubular stub shaft 120 that communicates with the aligned openings 80, 81, and that depends from the bottom beam 28 so as to extend coaxially along the center axis 40. A discharge opening 122 is defined by the lower end region of the tubular stub shaft 120.

Referring still to FIG. 2, a tapered, stopper-like valve member 84 is provided for controlling the flow of coating constituents from the large tank 52 through the outlet opening 80 and through the tubular stub shaft 120 for downward discharge onto the traffic surface 12 through the discharge opening 122. A control rod 85 carries the valve member 84 and extends upwardly through the tank 52 along the center axis 40 to define a coarsely threaded upper end region 86 that is threaded through a coarsely threaded nut 87. The nut 87 is welded to the top beam 38. An operator control in the form of a handle 88 is provided for threading the control rod 85 through the nut 87 to vertically position the valve member 84 relative to the outlet opening 80. By this arrangement, an operator can move the valve member 84 between positions of seating engagement with such structure as defines the outlet opening 80 to positions that selectively permit and regulate the flow of contents from the tank 52 through the outlet opening 80. The coarse threads provided on the upper end region 86 and within the nut 87 permit the valve member 84 to be moved vertically as by rotating the control rod 85 about the axis 40 through relatively few revolutions so that an operator can effect the desired positioning of the valve member 84 quickly and easily. A guide and support structure 89 is provided within lower regions of the tank 52 to assist in maintaining alignment of the control rod 85 with the center axis 40, and to assure smooth movements of the valve member 84 into and out of seating engagement with such structure as defines the outlet opening 80.

Disposed beneath the carriage assembly 20 and extending in a radially arranged array relative to the center axis 40 is a set of rotary finishing tools 200 that is power driven to rotate about the center axis 40 (as will be described), and that functions to effect mixing, spreading and application to the traffic surface 12 of such coating constituents as are dispensed onto the traffic surface 12 from carriage supported containers such as the tanks 52, 54 of the tank assembly 50 (which also will be described). However, before turning to a description of the rotary finishing tools 200, and before discussing the various modes of operation of the apparatus 10, the discussion that was begun above of various carriage supported components and features thereof will be completed.

Referring to FIGS. 3 and 4, the side bars 22 of the carriage structure 20 extend rearwardly beyond the rear wall 64 of the large tank 52. Rearwardly extending portions of the side bars 22 are bridged by a plate 108. The plate 108 is secured atop the rearwardly-extending portions of the side bars 22, atop the rear cross bar 24, and atop the trailer bar 26, and thereby define a support platform 110 that extends across the back of the machine 10.

Referring to FIGS. 2 and 4, a gasoline engine 150 is rigidly connected to the support platform 110 to provide power for driving the rotary finishing tools 200, and to provide power for driving the rear wheels 18 to move the machine 10 forwardly along a desired travel path. A drive shaft 152 depends from the engine 150 and carries a centrifugal clutch 160. The engine 150 and the centrifugal clutch 160 are conventional, commercially available items that are available from a variety of sources. In preferred practice, the engine 150 is selected to be of the type that will idle smoothly at a speed of about 1,000 revolutions per minute (rpm) and at lesser speeds; and that is of the type that is intended to supply rotary power at speeds within the range of about 1,500 to 3,000 rpm. In preferred practice, the centrifugal clutch 160 is selected to be of the type that must be driven at a speed of at least about 1,500 rpm (or at higher speeds) in order for the clutch 160 to transmit rotary motion from the engine's drive shaft 152 (on which inner diameter portions of the clutch 160 are mounted) to a double V-belt pulley 162 that is defined by outer diameter portions of the clutch 160. By this arrangement, when the engine 150 is shut off or is idling at an engine speed of less than about 1,500 rpm, no rotary motion is transferred from the engine's drive shaft 152 to the double V-belt pulley 162; however, when engine speed is within the range of about 1,500 to about 3,000 rpm, the centrifugal clutch 160 serves to directly drivingly connect the engine's drive shaft 152 to the double V-belt pulley 162 for concurrent rotation.

Referring to FIGS. 1 and 3, a throttle knob 149 is provided near the handle 118 that an operator utilizes to steer the machine 10. By adjusting the knob 149, the operator is able to control the operating speed of the engine 150. A conventional Bowden cable 147 connects with the throttle knob 149 and with the engine 150 in the usual manner to control the supply of gasoline to the engine, and to thereby control engine operating speed.

Figure 6:
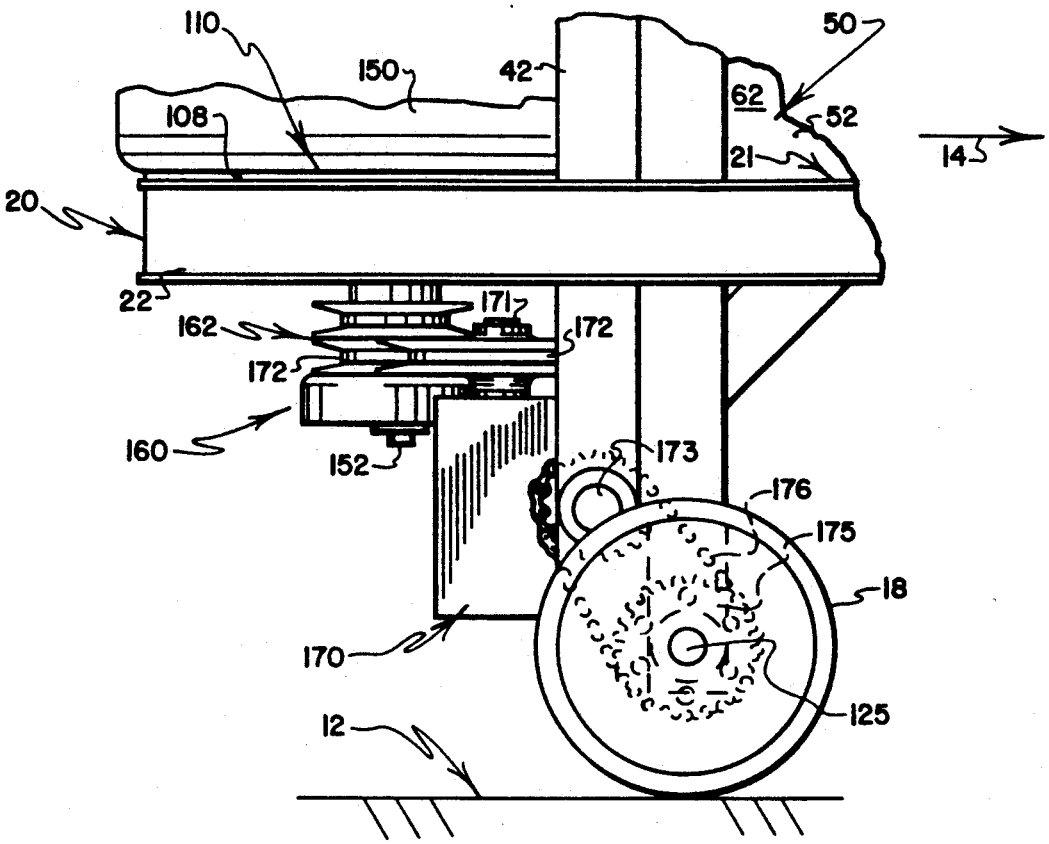
FIG. 6 is a right side elevational view, on an enlarged scale, showing components of the carriage, its right rear drive wheel, and selected other apparatus components; and, FIG. 7 is a left side elevational view, on an enlarged scale, showing components of the carriage, its left rear drive wheel, and selected other apparatus components.

Referring to FIG. 3 and 4, two V-belts 164, 166 are reeved around and drivingly connect with the pulley 162. The V-belt 164 is relatively short, is reeved around the lower half of the double pulley 162, and extends toward the right side of the machine (i.e., rightwardly with respect to the forward direction of movement of the machine 10, as is indicated by the arrow 14 in FIG. 3) for establishing a driving connection between the pulley 162 and a pulley 172 that is connected to an input shaft 171 of a right angle speed reducer unit 170. An output shaft 173 of the unit 170 carries a sprocket 174. A roller chain 176 is reeved around the sprocket 174 and extends downwardly and forwardly (as is best seen in FIG. 6) to establish a driving connection between the sprocket 174 and a sprocket 175. The sprocket 175 is drivingly connected to a rear axle 125 that drives the rear wheels 18 of the machine 10, as will be explained.

In preferred practice, the reduction in speed that is provided by the speed reducer unit 170 is selected such that, when the engine 150 is operated within a normal range of from about 1,500 to about 3,000 rpm, the rear wheels 18 are caused to rotate so as to drive the machine 10 across the traffic surface 12 in a forward direction 14 at a rate of speed that falls within a normal range of from about 1½ to about 3 miles per hour.

The other V-belt 166 is reeved around the upper half of the double pulley 162, and extends toward the left side of the machine 10 (i.e., leftwardly with respect to the forward direction of movement of the machine 10, as is indicated by the arrow 14 in FIG. 3) for establishing a driving connection between the pulley 162 and a pulley 182 that is connected to an stub shaft 180. A bearing block, indicated generally by the numeral 181 in FIG. 3, rotatably mounts the stub shaft 180 for rotation relative to the carriage structure 20 about a substantially vertical axis.

The pulley 182 is of relatively large diameter and cooperates with the much smaller diameter pulley 162 to cause the stub shaft 180 to rotate at a relatively slow speed in response to rotation of the clutch pulley 162. Also carried on the stub shaft 180 for concurrent rotation therewith is a relatively small diameter pulley 184. A third V-belt 186 is reeved around the pulley 184 and extends toward the center axis 40 of the machine 10 where it is reeved around a relatively large diameter pulley 188 for driving the pulley 188 at a further reduced speed of rotation with respect to the speed of rotation of the clutch pulley 162. As will be explained in conjunction with the description that follows later herein of the rotary tool unit or assembly 200, the pulley 188 is drivingly connected to the rotary tool unit 200 and serves to rotate the unit 200 about the center axis 200 in a direction of rotation that is indicated in FIG. 3 by an arrow 190.

Referring to FIG. 1, the front wheels 16 are conventional, commercially available swivel caster assemblies that are connected by short post-like spacers 116 to front corner regions of the carriage structure 20. The provision of swivel caster assemblies to comprise the front wheels 16 is desirably in that, as the machine 10 is moved forwardly, the desired path of travel often is of a curved nature, whereby it is necessary for the machine 10 to be guided by an operator who walks ahead of the machine 10 and controls its direction of movement as by exerting force on a handle 118 that extends forwardly from the front cross bar 34 of the upper welded framework 31. To protect the operator from being inadvertently splattered with coating constituents as the rotary tools 200 operate beneath the carriage structure 20, a curved guard member 120 preferably is attached to and depends from the carriage structure 20 at a location extending between the front wheels 16.

Figure 7:
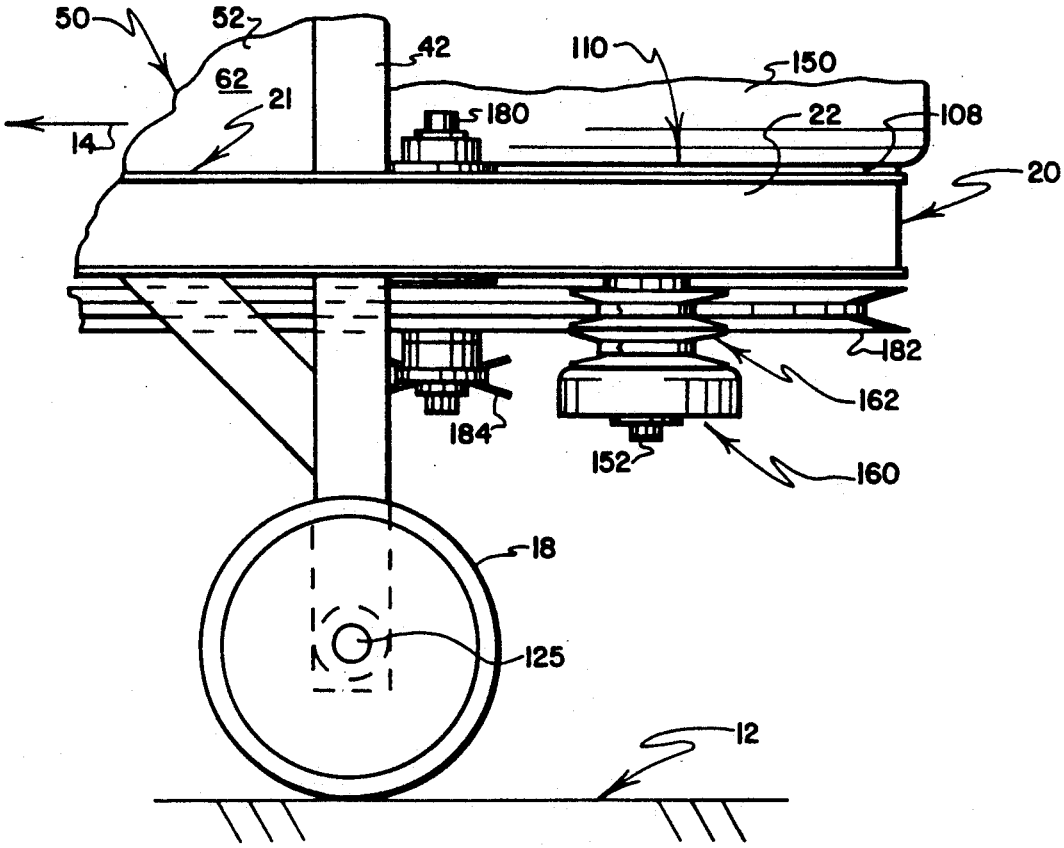

Referring to FIGS. 6 and 7 in conjunction with FIG. 1, the rear wheels 18 are conventional, commercially available drive wheels of a type that have center holes for receiving opposed end regions of the rear axle 125. As is best seen in FIGS. 3 and 4, the rear axle 125 extends between the left and right rear wheels 18, and beneath rear portions of the tank assembly 50.

In preferred practice, the wheels 18 are commercially purchased drive wheel assemblies that are available from a variety of manufacturers and distributors, and that are selected to be of the type that each incorporate (as an integral component of its assembly) a one-way clutch (not shown) that 1) provides for transmission of rotary motion from the axle 125 to the wheels 18 in one direction of rotation only, and 2) permits what is referred to in the art as "overdrive" of either of the wheels 18 relative to the axle 125 in said one direction of rotation. By this arrangement, when the axle 125 is driven in a proper direction to rotate the wheels 18 for moving the machine 10 forwardly, a driving force that is imparted to the wheels 18 by the axle 125, and this driving force normally will cause the wheels 18 to rotate in unison, as though they were rigidly interconnected. However, if an operator who is guiding the machine 10 as by applying force to the handle 118 wants to turn the machine 10 (so as to deviate from a straight line path of travel), he or she can apply added forwardly directed force to advance either the left or right sides of the machine 10 at a faster pace than is being provided by the power-driven wheels 18, and the one-way clutches that are incorporated in the wheel assemblies 18 will permit the needed "overdrive" of the left or right rear wheel 18 to take place as may be needed to selectively advance either the left or right side of the machine 10 to thereby effect the desired steering or turning action.

As a more commonly employed and somewhat more conventional alternative, a "differential" unit (not shown) of the general type that is used to transmit rotary drive motion to the left and right rear wheels of vehicles such as automobiles and the like, or other types of drive axle mechanisms that permit rotary drive energy to be transmitted to a pair of axles while permitting some relative movement between the driven axles, may be employed in an appropriate manner, as will be well understood by those who are skilled in the art, in place of wheel assemblies that are provided with one-way clutches. A disadvantage of the use of wheel assemblies that incorporate one-way clutches is that the presence of the clutches often makes it difficult for an operator to reverse the forward movement of a power-driven machine—which, in some instances, may not provide an acceptable solution, especially if the machine 10 is to be used in tight quarters wherein a capability for ease of maneuvering is of importance. An advantage, on the other hand, of the use of wheel assemblies that incorporate one-way clutches is that, if the power-driven machine is being operated principally in an uphill-driven mode, the presence of the one-way clutches often is an asset in preventing unwanted downhill movement of the machine both while the machine is being driven and when the machine is at rest.

Referring to FIGS. 1-3, a finishing blade assembly 130 is supported by rearward portions of the carriage structure 20 and provides a resilient blade-like member 132 that depends from a mounting assembly 134 toward a position of engagement with the traffic surface 12. The mounting assembly 134 includes a pair of brackets 135 that are connected to the carriage structure 20 near opposite sides thereof for mounting the resilient member 132 to extend across substantially the full width of the travel path that is traversed by the machine 10, with the resilient member 132 depending into engagement with the traffic surface at a location behind the rear wheels 18.

Figure 5:
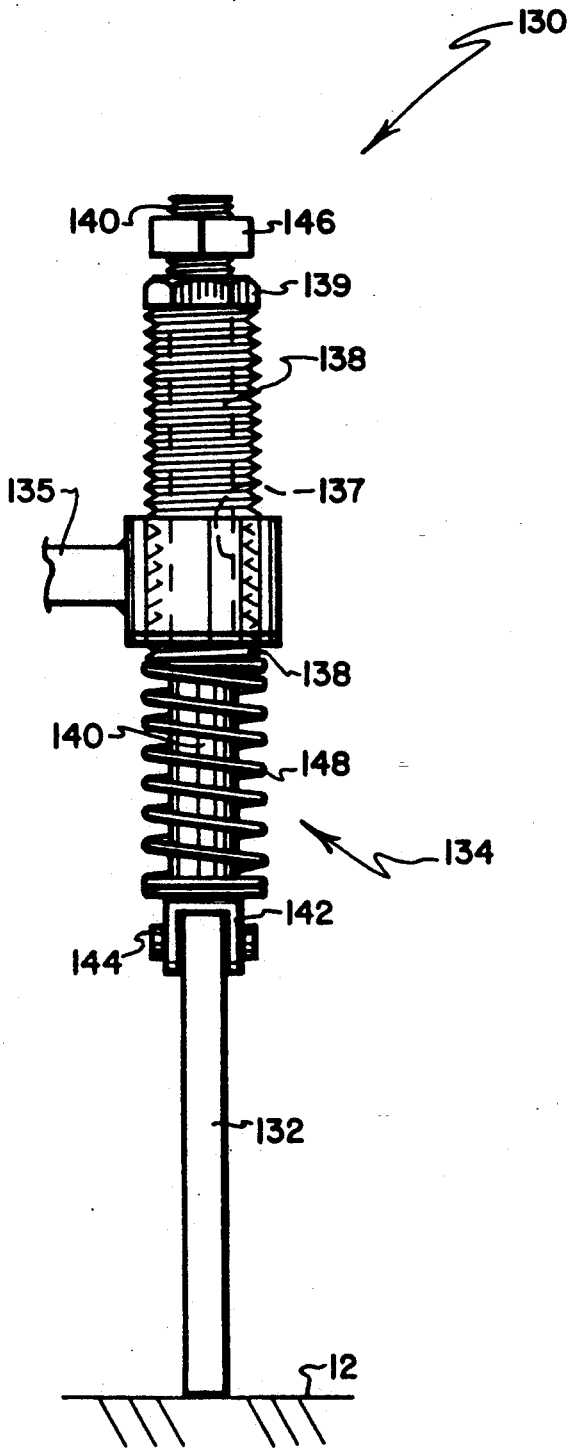
FIG. 5 is a left side elevational view, on an enlarged scale, showing components of a finishing blade assembly that is supported by rear portions of the carriage of the apparatus.

Referring to FIG. 5, the brackets 135 define internally threaded, substantially vertically extending holes 137. Externally threaded tubular adjustment sleeves 138 are threaded into the holes 137 and have hex formations 139 near their upper end regions for permitting a wrench to be utilized to thread the sleeves upwardly or downwardly through the holes 137 as may be needed to selectively adjust the position of the resilient member 132 relative to the traffic surface 12. A pair of support rods 140 extend through the sleeves 138. Lower end regions of the support rods 140 define yoke formations 142 that receive upper edge portions of the resilient member 132, and that are connected to the received upper edge portions as by fasteners 144 that extend through aligned holes that are formed through the yoke formations 142 and through the upper edge portions of the resilient member 132. Upper end regions of the support rods 140 are threaded and carry, and carry at least one lock nut 146. Compression coil springs are 148 are interposed between lower end regions of the tubular adjustment sleeves 138 and between the yoke formations 142 to bias the resilient member 132 downwardly toward engagement with the traffic surface 12. By treading the sleeves 138 upwardly or downwardly relative to the support brackets 135, and by selectively positioning the lock nuts 146 on the support rods 140, the resilient member 132 can be positioned such that its lower end region gently engages the traffic surface 12, the permissible range of vertical movement of the resilient member can be defined, and the extent to which the compression coil springs 148 exert a downwardly biasing action on the resilient member 132 can be adjusted.

Referring principally to FIG. 2, but also with occasional reference to FIGS. 3 and 4, the rotary tool unit 200 includes a rotary member 210 that is rotatably connected by bearings 212 to the hollow, depending stub shaft 120 through which coating constituents from the tank 52 are dispensed for deposit onto the traffic surface 12. The rotary member 210 is a four-sided block of steel (see FIG. 3), through which a centrally-extending passage 216 has been formed that is enlarged near its upper and lower end regions to receive the bearings 212. A snap ring 218 (FIG. 2) engages a circumferentially extending groove that is formed toward the bottom end region of the stub shaft 120 to hold a washer 222 in place above the snap ring 218. The washer 222 engages the bottom bearing 212 and assists in retaining the rotary member 210 in place on the stub shaft 120. A sleeve-like spacer 224 is provided atop the upper bearing 212 and extends into engagement with portions 226 of the carriage structure 20 to which the stub shaft 120 is connected.

The pulley 188 is bolted to the upper end region of the rotary member 210 and serves to rotate the rotary member 210 about the center axis 40 preferably within the range of about 40–60 rpm in response to operation of the engine 150 at speeds within the range of about 1,500–3,000 rpm.

Referring to FIG. 3, the four-sided block of steel that forms the rotary member 210 carries four yoke-like formations 230 that extend radially outwardly from the center axis 40, with each of the formations 230 extending substantially perpendicular to its two nearest neighbor formations 230. Inner end regions 242 of four tubular arms 240 are received within the yoke-like formations 230, and are pivotally connected thereto by pivot pins 244 that extend substantially horizontally through aligned holes formed in the yoke formations 230 and in the inner end regions 242 of the tubular arms 240.

Four blade-like applicator tools 250 are positioned beneath outer end regions 248 of the tubular arms 240. The applicator tools 250 can take any of a variety of forms, but preferably take the forms that are described in detail in the referenced Parent Patents, whereby each of the tools 250 has a resilient, blade-like bottom portion 252 that extends upwardly and connects with a rigid support 254 that is pivotally connected to a separate one of outer end regions 248 of the arms 240. In preferred practice, yoke-like structures 256 are defined by the supports 254 to extend along opposed sides of the outer end regions 248, and pivot pins 260 extend through aligned holes that are formed through the outer end regions 248 and through the yoke-like structures 256 to pivotally connect the applicator tools 250 to the radially extending arms 240.

While the arms 240 extend substantially radially with respect to the center axis 40, as is best seen in FIG. 3, the blade-like applicator tools 250 are inclined relative to the arms 240 so that outer end regions of the blades 250 tend to lead inner end regions when the rotary tool unit 200 is rotated about the axis 40 in a forward direction of rotation indicated in FIG. 3 by the arrow 190. Moreover, the pivot pins 260 that pivotally connect the blade-like applicator tools 250 to the tubular arms 240 preferably are inclined relative to the horizontal by a small amount, typically about five degrees, so that upper portions of the blade-like applicator tools 250 tend to slightly lead lower portions of the tools 250 when the rotary tool unit 200 is rotated in the direction of the arrow 190. This slight inclination of the applicator tools to cause the traffic-surface-engaging portions of the blades to trail or "drag" has been found to help prevent tool "chatter," and to help assure that the machine 10 has the capability to apply a smooth coating to the traffic surface 12.

A number of advantages obtain with the use of the above-described type of center-fed dispensing system in combination with a rotary tool unit of the type that has been described, and wherein the dispensing is being carried out as the first step in a process of mixing, spreading and applying coating constituents to a traffic surface. Especially when a quantity of coating constituents that is to be dispensed comprises a runny, non-viscous liquid that is relatively easy to mix, spread and apply, an improved result often obtains if the dispensing takes place centrally relative to a set of rotating tools so that, as the machine that carries the rotating tools moves across a surface that is to be coated, the relatively slowly moving inner end regions of the blade-like applicator tools are first brought into engagement with the newly deposited coating constituents so that a relatively gentle mixing action can be initiated before faster moving blade portions are brought into engagement therewith to effect spreading and application of the resulting coating.

Furthermore, when a relatively non-viscous, easily spread liquid is to be mixed, spread and applied in combination with a relatively heavy dry particulate material such as sand, advantages have been found to exist in using a non-center-fed type of dispensing system for spreading the sand relatively widely across the path of travel, and then by utilizing a center-fed dispensing system with rotating blade-like applicator tools to mix, spread and apply the resulting mixture of coating ingredients.

Still further, the use of a finishing blade to extend substantially the full width across a travel path so as to effect a final smoothing of a center-fed coating mix, spread and apply operation that has been carried out utilizing one or more sets of rotary tools has proved to further enhance the quality of the resulting coating in many instances.

Although the invention has been described in its preferred form with a certain degree of particularity, it is understood that the present disclosure of the preferred form has been made only by way of example and that numerous changes in the details of construction may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A method of applying to a traffic surface a coating composition consisting of plural ingredients, herein the method comprises the steps of:

a) depositing a plurality of coating composition ingredients upon a traffic surface to be coated;

b) bringing into contact with the deposited ingredients at least one set of rotary tools, with each such set of rotary tools including an associated rotary structure having a plurality of associated depending blades that are arranged in an array about an associated center axis that extends substantially normal to the traffic surface, and having connection means movably connecting at least selected ones of the associated blades to the associated rotary structure so that, when the associated rotary structure and the associated blades are rotated about the associated center axis, at least said selected ones of the associated blades are permitted to move a limited amount relative to the associated rotary structure so as to accommodate the character of such portions of the traffic surface as pass beneath said selected associated blades and to maintain relatively close, substantially parallel contact with such portions of the traffic surface;

c) rotating said at least one set of rotary tools about its associated center axis with at least said selected associated blades being urged into substantially continuous contact with the traffic surface and into contact with the deposited ingredients to effect a rapid mixing of the ingredients to a condition of substantially uniform consistency;

d) applying the coating that results from the mixing of said ingredients to the traffic surface by continuing to rotate said at least one set of rotary tools about its associated center axis, with at least said selected associated blades moving relative to their associated rotary structure as is needed to conform to the contour of and to substantially maintain contact with such traffic surface portions as are being coated; and, e) with the step of depositing a plurality of coating composition ingredients upon a traffic surface being carried out substantially simultaneously with each of the other steps recited above, and including the steps of:

i) ducting a flow of at least a portion of the coating composition ingredients that are to be deposited to and through a discharge station so as to deposit the flow of ingredients onto traffic surface portions that underlie the discharge station, with the discharge station being located substantially centrally with respect to at least one array of the rotating, depending blades; and, ii) moving the center axis of said at least one array along a path of travel that extends across the traffic surface to be coated so that the associated rotating, depending blades are brought into engagement with the deposited coating composition ingredients to effect said mixing of coating composition ingredients and said application of the resulting coating to the traffic surface.

2. The method of claim 1 additionally including the steps of:

a) providing carriage means for supporting the rotary tools for travel along said path of movement across the traffic surface; and, b) providing power drive means for rotating the rotary tools about their associated center axis; and, c) wherein the step of bringing the rotary tools into contact with deposited ingredients includes moving the carriage means along said path of travel while operating the power drive means to rotate the rotary tools about their associated center axis.

3. The method of claim 2 additionally including the steps of:

a) providing the carriage means with wheel means for supporting the carriage means for movement in a forward direction along said path of travel across the traffic surface; and, b) providing surface coating smoothing means that is supported by the carriage means for engaging portions of the traffic surface at locations behind the wheel means; and, c) wherein the step of moving the carriage means along said path of travel is effected with the surface smoothing means in engagement with traffic surface portions that are located behind the wheel means to aid in smoothing the applied coating at such locations, and to minimize the presence in the applied coating of wheel tracks.

4. The method of claim 2, wherein:

a) the step of providing carriage means includes the steps of:

i) providing support structure that overlies the rotary tools and that defines a reservoir for containing a supply of coating ingredients at a location overlying the discharge station;

ii) providing a hollow, tubular member that communicates with the reservoir and extends downwardly therefrom substantially concentrically about the center axis for ducting coating constituents from the reservoir to the discharge station; and, iii) providing bearing means that connects with the hollow, tubular member and that mounts said rotary structure thereon for rotation relative to the carriage means about the center axis;

b) the step of providing power drive means for rotating the rotary tools about the center axis includes the steps of providing a source of rotary drive force that is supported by the carriage and that is drivingly connected to the rotary structure for rotating the rotary structure about the center axis, and to transmit rotational motion through the connection means to the associated blades to effect rotation of the associated blades about the center axis; and, c) the step of ducting a flow of at least a portion of the coating composition ingredients to the discharge station includes the step of providing a controlled flow of said coating composition ingredients from said reservoir through said hollow, tubular member to and through said discharge station for discharge onto such traffic surface portions as underlie the discharge station.

5. The method of claim 4 wherein the step of providing a controlled flow includes the steps of:

a) providing a flow control valve for regulating the flow of said coating composition ingredients from said reservoir to and through said discharge station; and, b) adjusting said flow control valve to provide a desirably controlled flow of said coating composition from said reservoir to and through said discharge station for discharge onto such traffic surface portions as underlie the discharge station.

6. The method of claim 4, wherein:

a) the step of providing carriage means also includes the steps of:

i) providing container structure that does not communicate with said reservoir, and that defines a compartment for containing a supply of such coating ingredients as are to be mixed with the coating ingredients that are contained in said reservoir in order to provide a desired type of resulting coating on the traffic surface; and, ii) providing discharge control means for selectively permitting a controlled flow of such coating ingredients to discharge from said compartment onto the traffic surface;

b) the step of depositing a plurality of coating composition ingredients includes dispensing flows of such ingredients substantially simultaneously from said reservoir and from said compartment; and, c) the steps of rotating the rotary tools about the center axis to mix and apply the coating serves to mix in situ on the traffic surface such coating constituents as are deposited on the traffic surface by said flows from said reservoir and from said compartment.

7. The method of claim 6 wherein the step of dispensing a flow of ingredients from said compartment includes the step of depositing the ingredients from said flow at a location along said path of travel that is relatively forward with respect to the location along said path of travel of said rotary tools.

8. The method of claim 4 wherein the step of moving the carriage means along the path of travel includes the step of utilizing rotary drive force generated by the power drive means for rotating at least selected ones of the wheel means to at least assist in moving the carriage means.

9. The method of claim 1 wherein the step of depositing ingredients upon a traffic surface includes the step of depositing separate flows of different ingredients from separate sources of supply.

10. The method of claim 9 wherein the step of depositing separate flows of ingredients upon a traffic surface includes the step of intermittently starting and stopping the deposit of at least a selected one of the separate flows ingredients to accommodate variations in the condition of the traffic surface being coated.

11. The method of claim 1 wherein the step of rotating the plurality of rotary tools includes the step of adjusting the speed of tool rotation to accommodate the nature of the ingredients that are being applied to the traffic surface.

12. The method of claim 11 wherein the step of adjusting the speed of tool rotation includes the step of maintaining the speed of tool rotation about the center axis within the range of about 40 rpm to about 60 rpm.

13. The method of claim 2 wherein the step of moving the carriage means along said path of travel includes the step of maintaining forward movement of the carriage means along the path of travel within the range of about 1½ miles per hour to about 3 miles per hour.

14. The method of claim 9 wherein the step of depositing separate flows of different ingredients from separate sources of supply includes the step of metering the deposition flows of said ingredients, and wherein the step of moving the center axis of the rotating tools along the path of travel includes the steps of:

a) controlling the speed of movement of the center axis along said path; and, b) adjusting both the deposition flow rates and said speed of movement in relationship to each other to accommodate both the nature of the coating being applied and the nature of the surface being treated.

15. The method of claim 14 further including the step of controlling the speed of rotation of the rotary tools about the center axis, and controlling the speed of movement of the center axis along the travel path in relationship to each other to accommodate the nature of the coating being applied and the condition of the traffic surface being coated.

16. Apparatus for applying to a traffic surface a coating composition consisting of plural ingredients, the apparatus comprising:

a) carriage means including a frame and wheels for supporting the frame atop a traffic surface to be coated, and having an imaginary center axis that extends substantially normal to such portions of the traffic surface as extend along a path of travel and underlie the carriage means as the carriage means moves across traffic surface portions while moving along the travel path;

b) supply source means including at least one container that is connected to the carriage means as by being mounted on the frame for containing coating constituents that are to be applied to the traffic surface, with said container having a bottom wall that intercepts the center axis, and having bottom wall portions that define an outlet opening that extends about the center axis;

c) dispensing means connected to the frame and including:

i) a hollow tubular member that communicates with said outlet opening and depends along the center axis from the location of said outlet opening for defining a discharge opening that is spaced below the outlet opening, with the discharge opening being spaced above traffic surface portions that underlie the carriage;

ii) valve means for selectively permitting and regulating the flow of coating constituents from said container through said discharge opening, including a valve member that is configured to seatingly engage the outlet opening that is provided in the bottom wall of said container for selectively blocking the flow of coating constituents from said container through the outlet opening, and for selectively permitting a regulated flow of coating constituents from said container through the outlet opening; and, iii) valve control means for positioning the valve member relative to the outlet opening so as to selectively move the valve member between a position blocking the flow of coating constituents from said container through the outlet opening, and a position that opens said outlet opening sufficiently to provide a regulated flow of coating constituents through the outlet opening;

d) applicator means for mixing the deposited ingredients in situ on the traffic surface, and for spreading and applying the resulting coating composition to the traffic surface, including at least one set of rotary tools, with said set including:

i) an associated rotary structure that extends about and is movably connected to said hollow tubular member for being rotated about the center axis;

ii) a plurality of associated depending blades that are arranged in an array about the center axis;

iii) connection means for movably interconnecting at least selected ones of the associated blades to the associated rotary structure for permitting limited movements of the selected associated blades relative to the associated rotary structure so as to accommodate the character of such portions of the traffic surface as pass beneath said selected associated blades and to maintain relatively close, substantially parallel contact with such portions of the traffic surface as the carriage means moves along the path of travel;

e) power drive means connected to the carriage means as by being supported on the frame, and including:

i) engine means for rotating a drive shaft;

ii) centrifugal clutch means drivingly connected to the drive shaft, having output means, and being operable to drivingly connect the drive shaft with the output means for concurrent rotation when the engine is rotating the drive shaft at or above a predetermined speed of rotation;

iii) first drive connection means drivingly connected to the output means for transferring rotary drive motion from the output means to at least selected ones of the wheels that support the frame for effecting self-propelled movement of the carriage means along the travel path across the traffic surface; and, iv) second drive connection means drivingly connected to the output means for transferring rotary drive motion from the output means to the rotary structure for rotating the associated depending blades about the center axis as the carriage means moves along the travel path to effect mixing, spreading and application of the dispensed coating constituents to coat the traffic surface.

17. A rotary tool apparatus for depositing coating constituents on a traffic surface, for forming a coating composition on a traffic surface by mixing and spreading the deposited constituents, and for applying the resulting coating composition to the traffic surface as by smoothly spreading the same thereover irrespective of the lateral dimensions of the traffic surface, comprising:

a) wheel-supported frame means having at least one substantially vertically extending center axis, with the frame means including a frame structure and a plurality of wheels for supporting the frame structure atop a traffic surface;

b) power drive means connected to and supported by the frame means for providing a source of rotary motion;

c) hollow, tubular stub shaft means rigidly connected to and supported by the frame means, including at least one hollow, tubular structure that extends about a separate one of said at least one center axis, and having a lower end region that depends from the frame means along its associated center axis to for defining an associated discharge opening that is spaced above traffic surface portions that underlie the carriage;

d) reservoir means connected to and supported by the frame means and defining interior region means for receiving and containing one or more quantities of coating constituents, including at least one tank-like structure having a bottom wall portion means that cooperates to define at least a part of said interior region means, with the bottom wall portion means having outlet opening means formed therethrough including at least one separate outlet opening that is associated with each of the separate tank-like structures, with said least one outlet opening being positioned within relatively close proximity to at least one associated center axis;

e) dispensing means for ducting one or more controlled flows of coating constituents from said outlet opening means into the associated hollow, tubular stub shaft means that extends along said associated center axis, and for discharging such ducted controlled flows through said associated discharge opening onto traffic surface that underlie said associated hollow, tubular stub shaft means, including:

i) conduct means for communicating said at least one part of said interior regions means with the interior of said associated hollow, tubular stub shaft means for ducting at least one flow of coating constituents from said outlet opening means into said associated hollow, tubular stub shaft means for discharge through said associated discharge opening;

ii) valve means including a separate valve member associated with each of said outlet openings for selectively permitting and preventing said at least one flow of coating constituents to discharge from said reservoir means through said associated outlet opening and into said conduct means, with each of the separate valve members being configured to be moved into and out of seated, sealing engagement with such structure as surrounds and defines its associated outlet opening; and, iii) valve control means for positioning each of said valve members relative to its associated outlet opening so as to selectively move such valve member between a position of seated, sealing engagement with such structure as surrounds the associated outlet opening, and positions spaced from the associated outlet opening that selectively permit an associated controlled flow of coating constituents through the associated discharge opening into portions of the associated conduit means and through portions of the associated hollow stub shaft means for discharge through the associated discharge opening onto underlying portions of the traffic surface;

f) applicator means for mixing the deposited constituents in situ on the traffic surface, and for spreading and applying the resulting coating composition to the traffic surface, including at least one set of rotary tools, with each such set including:

i) an associated rotary structure that extends about and is movably connected to a selected one of said hollow, tubular stub shafts for being rotated about the associated center axis;

ii) an associated blade set including a plurality of associated depending blades that are arranged in an array about the associated center axis;

iii) connection means for movably interconnecting at least selected ones of the associated blades to the associated rotary structure for permitting limited movements of the selected associated blades relative to the associated rotary structure so as to accommodate the character of such portions of the traffic surface as pass beneath said selected associated blades during rotation of the associated blades about the associated center axis, and to maintain relatively close, substantially parallel contact with such portions of the traffic surface as the carriage means moves along the path of travel; and, g) power drive means connected to and supported by the frame means for rotating at least one of said sets of rotary tools about its associated center axis as said carriage means is caused to travel across selected portions the traffic surface that reside along a path of travel, with the dispensing means being operated during such travel to deposit coating constituents onto said selected portions of the traffic surface, and with the rotation of said rotary tool means by said power drive means serving to mix and spread the deposited coating constituents, and to apply the resulting coating to said selected portions of the traffic surface.

18. The rotary tool apparatus of claim 17, wherein the power drive means includes engine means for providing a power driven drive shaft that serves as a source of rotary motion, throttle means connected to the engine means for controlling the speed of rotation of the drive shaft, clutch means including 1) input means drivingly connected to the drive shaft for rotation in response to rotation of the drive shaft, 2) output means drivingly connected to said rotary tool means for supplying rotary energy thereto for rotating said rotary tool means about said at least one associated center axis, and drive coupling means for selectively drivingly interconnecting the input means with the output means for selectively transmitting rotary energy therebetween to rotate the output means in response to rotation of the input means.

19. The rotary tool apparatus of claim 18, wherein said clutch means includes a centrifugal clutch that has an input that defines said input means, an output that defines said output means, and means for defining said drive coupling means for selectively drivingly connect the input means with the output means for concurrent rotation only when the engine is rotating the drive shaft at or above a predetermined speed of rotation.

20. The rotary tool apparatus of claim 18 wherein said drive coupling means is operative to drivingly connect the input means with the output means when the speed of rotation of the drive shaft is within the range of about 1,500 rpm to about 3,000 rpm, and wherein the speed of rotation that is thereby imparted to the rotary tool means is within the range of about 45 rpm to about 60 rpm.

21. The rotary tool apparatus of claim 18 additionally including propulsion drive connection means for drivingly connecting the drive shaft of the engine means to at least selected ones of the wheels that support the frame structure for effecting self-propelled movement of the frame means across the traffic surface along the path of travel.

22. The rotary tool apparatus of claim 21 wherein said propulsion drive connection means is operative to effect self-propelled movement of the frame means across the traffic surface at a speed within the range of about 1½ mph to about 3 mph in response to operation of the engine means to rotate the drive shaft within the range of about 1,500 rpm to about 3,000 rpm.

23. The rotary tool apparatus of claim 21 wherein said propulsion drive connection means includes axle means rotatably connected to the frame means and extending transversely with respect to a forward direction of movement along the path of travel for mounting said selected ones of the wheels, and rotary motion transmitting means for drivingly connecting said drive shaft and said axle for rotating said axle at a much reduced rate of speed in comparison to the speed of rotation of said drive shaft.

24. The rotary tool apparatus of claim 17 additionally including at least a pair of bearings for rotatably connecting said rotary structure that extends about and is movably connected to an associated hollow, tubular stub shaft for being rotated about the associated center axis, with such bearings being vertically spaced one from another along said associated center axis.

25. The rotary tool apparatus of claim 17 wherein:

a) auxiliary tank-like means is provided for containing coating constituents, with said auxiliary tank-like means being connected to and supported by the frame means; and, b) auxiliary dispensing means is provided for controllably dispensing contents from the auxiliary tank-like means onto the traffic surface at least one auxiliary location that is spaced forwardly along said path of travel relative to said discharge opening of said reservoir means.

26. The rotary tool apparatus of claim 25 wherein:

a) when said rotary tool means rotates about its associated center axis, it does so within a circle of movement that extends about its associated center axis; and, b) said auxiliary dispensing means is operable to dispensing coating constituents from said auxiliary tank-like means onto the traffic surface at said at least one auxiliary location, with such dispensed constituents being dropped onto the traffic surface outside said circle of movement at a location that is spaced forwardly from said circle of movement.

27. The rotary tool apparatus of claim 26 additionally including protective deflector skirt means that depends from front portions of the frame structure and that has center portions that extend forwardly as they depend downwardly for assisting to guide coating constituents that are dispensed from said auxiliary dispensing means to avoid their striking said rotary tool means, and to help assure that such dispensed constituents are dropped onto the traffic surface at locations that are outside said circle of movement of the rotary tool means.

28. The rotary tool apparatus of claim 17 additionally including skirt means that depends from at least selected portions of the frame means for selectively enshrowding at least selected portions of the rotary tool means to prevent unwanted object contact therewith.

29. The apparatus of claim 17 wherein the connecting means that movably interconnects a set of depending blades to an associated rotary structure includes a plurality of tubular arms that extend substantially radially relative to the associated center axis, with the arms having inner end regions pivotally connected to their associated rotary structure, and outer end regions pivotally connected to adjustable-angle blade mounting means for positioning the associated depending blades at selected angles of inclination relative to the radially extending arms.

30. The apparatus of claim 29 wherein the adjustable-angle blade mounting means supports inclines the associated depending blades such that each has a radially outer end region that leads its associated radially inner end region as the depending blades are rotated about the center axis during operation of the apparatus.

31. The apparatus of claim 29 wherein at least selected ones of the depending blades each includes a panel of resilient material that is supported along an upper edge region, and that has a lower edge region that is biased into toward engagement with the traffic surface.

32. The apparatus of claim 31 wherein the biasing of said selected ones of the depending blades toward engagement with the traffic surface is effected, at least in part, by the weight of the depending blades and their associated arms.

33. The apparatus of claim 29 wherein the arms are elongate, tubular member that have their radially inner and outer end regions received in radially inward and radially outward yoke-like formations that are connected to the rotary structure and to the depending blades, respectively, as by a set of inner pivot pins that extend through aligned holes formed through the inner end regions and the inner yoke-like formations, and as by a set of outer pivot pins that extend through aligned holes formed through the outer end regions and the outer yoke-like formations, respectively.

34. The apparatus of claim 33 wherein the pivot pins of at least one of the sets of inner and outer pivot pins extend substantially horizontally.

35. The apparatus of claim 34 wherein the pivot pins of the other of the sets extend along axes that are inclined slightly from the horizontal so as to incline the depending blades slightly from the vertical so as to cause lower portions of each of the depending blades to slightly trail associated upper portions of the depending blades as the rotary tools are rotated about the associated center axis during operation of the apparatus so as to minimize tool "chatter."

36. The apparatus of claim 17 additionally including smoothing means connected to the frame means and depending therefrom into engagement with traffic surface portions located behind all of the support wheels of the apparatus for assisting to smooth the applied coating and for minimizing wheel track marks in the resulting coating.

37. The apparatus of claim 36 wherein:

a) the smoothing means includes an elongate panel of resilient material that is positioned to extend substantially fully across the back of the frame structure of the apparatus; and, b) adjustable positioning means is provided for connecting the panel of resilient material to the frame structure, with the positioning means being adjustable to position bottom edge portions of the panel of resilient material selectively into closely spaced relationship and selectively into engagement with the traffic surface.

38. The apparatus of claim 37 wherein the adjustable positioning means includes a pair of brackets that connect with opposed side portions of the frame structure, with each of the brackets defining a substantially vertically extending opening extending therethrough that is internally threaded, and with the positioning means further including a pair of externally threaded sleeve means that each is connected to the panel of resilient material and that are threaded into a separate one of the threaded openings for adjustably positioning the height of the panel of resilient material relative to the traffic surface.

39. The apparatus of claim 38 wherein the sleeve means each have substantially vertically extending passages formed therethrough, and wherein the adjustable positioning means additionally includes 1) a pair of rod-like members that each extend through a separate one of the passages, have lower end regions connected to upper edge portions of the panel of resilient material, and have upper end regions that are threaded and carry lock nuts, with the rod-like members being free to move vertically within the passages so as to provide a mounting of the panel of resilient material that accommodates a limited amount of vertical movement of the panel of resilient material as its lower edge portions travel over and at least occasionally engage portions of the traffic surface.

40. The apparatus of claim 39 additionally including biasing means interposed between the rod means and their associated sleeve means for biasing the panel of resilient material downwardly toward engagement with the traffic surface.

41. The apparatus of claim 40 wherein the sleeve means carry wrench-engageable formations to facilitate their being adjusted as by being threaded upwardly or downwardly through the threaded openings of their associated brackets.

* * * * *